US005107565A

United States Patent [19]

Chun

[11] Patent Number: 5,107,565

[45] Date of Patent: Apr. 28, 1992

[54] LIGHT SYSTEM FOR VACUUM CLEANER

[75] Inventor: John M. Chun, Mound, Minn.

[73] Assignee: Whirlpool Corporation, Benton Harbor, Mich.

[21] Appl. No.: 53,382

[22] Filed: May 22, 1987

[51] Int. Cl.[5] ..... A47L 5/00

[52] U.S. Cl. ..... 15/324; 362/307

[58] Field of Search ..... 15/324, 49; 362/307

[56] References Cited

U.S. PATENT DOCUMENTS

| | | | |
|---|---|---|---|
| 2,120,011 | 6/1938 | Martinet | 15/8 |
| 2,132,007 | 10/1938 | Smith | 240/2 |
| 2,246,832 | 6/1941 | Becker | 15/16 |
| 2,253,997 | 8/1941 | Becker | 15/324 |
| 2,274,971 | 3/1942 | White | 240/2 |
| 2,281,858 | 5/1942 | Pierce | 15/16 |
| 2,287,911 | 6/1942 | Snyder | 15/16 |
| 2,378,587 | 6/1945 | Sherrer | 15/324 |
| 2,563,717 | 8/1951 | Gerber | 15/324 |
| 2,594,524 | 4/1952 | Vance | 15/324 |
| 2,604,578 | 7/1952 | Sutton | 15/324 |
| 2,637,062 | 5/1953 | Sutton et al. | 15/324 |
| 2,649,607 | 8/1953 | Vance | 15/324 |
| 2,770,000 | 11/1956 | Segesman | 15/333 |
| 3,142,083 | 7/1964 | Huston et al. | 15/324 |
| 3,328,820 | 7/1967 | Doersam | 15/324 |
| 4,412,276 | 10/1983 | Blinow | 362/307 |
| 4,675,791 | 6/1987 | Montgomery | 362/307 |

*Primary Examiner*—Harvey C. Hornsby
*Assistant Examiner*—Mark Spisich
*Attorney, Agent, or Firm*—Wood, Phillips, VanSanten, Hoffman & Ertel

[57] ABSTRACT

A vacuum cleaner nozzle structure having a low profile nozzle housing enclosing a lamp. Light-reflective sheets of glossy vinyl are affixed to the top, bottom and rear wall surfaces defining the lamp space and cooperate with the lamp to provide an extended range of illumination directly in front of the nozzle. The reflective sheet material is selected to provide enhanced diffuse illumination closely adjacent the lower front portion of the nozzle body.

9 Claims, 1 Drawing Sheet 37
36
37
22
12
10
14
13
11
15
17
24
33
18
26
19
38
22
23
15
35
21
25
20
16
12
3
3
17
F
27
24
39
30
39
28
26
33
35
34
39
30
28
31
25
32
29
27

LIGHT SYSTEM FOR VACUUM CLEANER

TECHNICAL FIELD

This invention relates to vacuum cleaners and in particular to light systems for use in vacuum cleaners for providing illumination of the subjacent floor surface forwardly of the vacuum cleaner nozzle.

BACKGROUND ART

A large number of different light systems have been developed for use in vacuum cleaners to illuminate the floor surface area immediately forwardly of the vacuum cleaner nozzle. In such systems, a lamp is conventionally mounted within an upper forward portion of the motor housing and illumination from the lamp is transmitted forwardly and downwardly through a suitable window in a front wall portion of the motor housing.

Where the motor housing is relatively tall, the location of the lamp may be at an elevated position, permitting the light to pass downwardly at a relatively large angle to the horizontal so as to illuminate the floor surface immediately in front of the lower front edge portion of the vacuum cleaner nozzle.

In recent vacuum cleaner nozzle designs, the profile of the nozzle has been reduced so as to prevent such relatively elevated location of the lamp. As a result, light from the lamp is directed more generally horizontally and, while illuminating a surface of the floor to be cleaned substantially in front of the nozzle, does not fully satisfactorily illuminate the floor surface immediately in front of the nozzle because of the interference with such illumination caused by the forwardly projecting lower front portion of the nozzle housing.

It is preferable to mount the lamp rearwardly of the front wall of the nozzle to avoid damage thereto in the use of the vacuum cleaner and, thus, a serious problem has arisen in the provision of suitable floor illuminating means in such low profile nozzles.

DISCLOSURE OF INVENTION

The present invention comprehends an improved illuminating means for use in a vacuum cleaner nozzle which permits the use of a low profile nozzle configuration, with the floor illuminating lamp disposed substantially rearwardly of the lower front edge portion of the nozzle, while yet effectively illuminating the floor surface area substantially directly in front of the nozzle.

More specifically, the invention comprehends the provision in a vacuum cleaner nozzle structure having a housing defining a front wall provided with a window for passing light from within the housing to forwardly and downwardly of the front portion, a generally horizontally extending top wall inclined at a small angle forwardly downwardly and having a downwardly facing surface, a generally horizontally extending bottom wall having an upwardly facing surface, and a generally vertically extending rear wall having a forwardly facing surface, the walls cooperatively defining a generally parallelepiped lamp space having a midportion, and a lamp at the midportion of the space, the provision of a layer of light-diffusing, reflective material on each of the top, bottom, and rear wall surfaces.

In the illustrated embodiment, the front wall lower portion projects forwardly from below the window and defines a forwardmost edge portion of the nozzle structure. The lamp is disposed to pass light directly through the window at a first range of small angles to the horizontal and the reflective material defines means for reflecting light from the lamp to pass from the layer of reflective material on the top wall downwardly through the window at an angle to the horizontal greater than the maximum angle of the direct illumination range.

The reflective material, in the illustrated embodiment, comprises a layer of light-diffusing sheet material affixed to the wall surfaces for reflecting light from the lamp.

The invention comprehends that the reflective sheet material be formed of a synthetic resin, such as vinyl resin, having a gloss white reflective surface.

The sheet material is adhered to the wall surfaces by an adhesive capable of withstanding a relatively high temperature, as may be developed by energization of the lamp, such as approximately 175° F. for a protracted period of time without loss of adhesion.

In the illustrated embodiment, the sheet material affixed to the top wall surface and the sheet material affixed to the bottom wall surface comprise identically configured sheets.

The sheets define opposite first and second transverse edges, the first transverse edge of the sheet adhered to the bottom wall being forwardly disposed, and the corresponding first transverse edge of the sheet adhered to the top wall being rearwardly disposed.

One of the sheet edges defines a rectilinear edge having a central recess and the other of the transverse sheet edges defines a projecting edge having a transverse midportion and aligned side portions at opposite sides of the midportion.

The vacuum cleaner nozzle structure illuminating means of the resent invention is extremely simple and economical of construction while yet providing the improved functioning discussed above.

BRIEF DESCRIPTION OF THE DRAWING

Other features and advantages of the invention will be apparent from the following description taken in connection with the accompanying drawing wherein.

BEST MODE FOR CARRYING OUT THE INVENTION

Figures 1, 2, 3, 4, 5, 6:
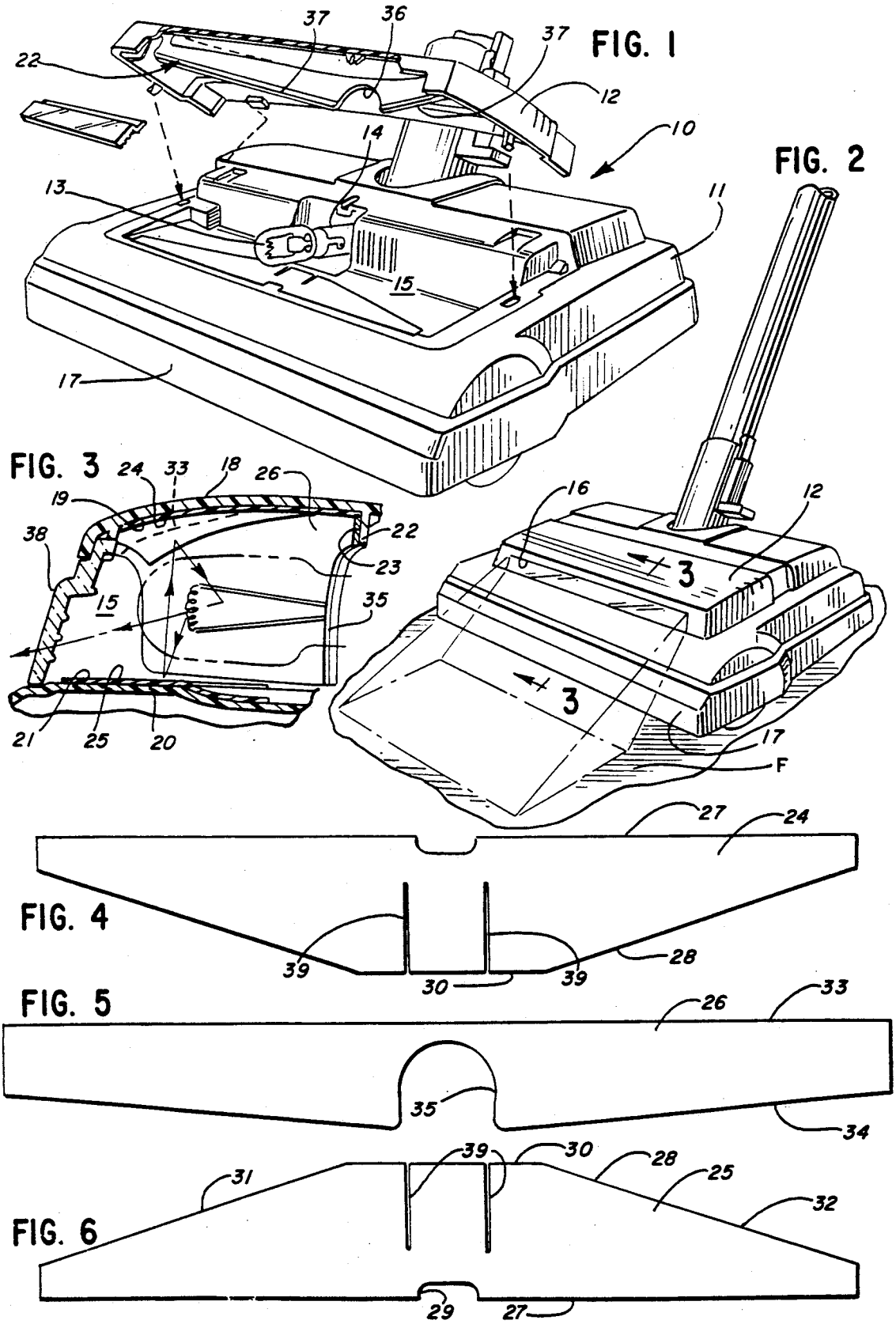
FIG. 1 is an exploded perspective view of a vacuum cleaner structure having an illuminating means embodying the invention.
FIG. 2 is a fragmentary perspective view illustrating the lighting coverage of the illuminating means.
FIG. 3 is a fragmentary vertical section taken substantially along the line 3—3 of FIG. 2.
FIG. 4 is a fragmentary plan view of the light-reflecting means affixed to the top wall surface of the lamp space.
FIG. 5 is an elevation of the light-reflecting means affixed to the rear wall surface of the lamp space.
FIG. 6 is a plan view of the light-reflecting means affixed to the bottom wall surface of the lamp space.

In the illustrative embodiment of the invention as disclosed in the drawing, a vacuum cleaner nozzle structure generally designated 10 is shown to comprise a wheeled nozzle body 11 and a removable lamp housing 12. A lamp 13 is mounted in an electrical socket 14 so as to be effectively centered in a lamp space 15.

Housing 12 is provided with a front opening defining a window 16 for passing light from the lamp space to forwardly and downwardly of the front portion 17 of the nozzle body 11.

Housing 12 defines a generally horizontally extending top wall 18 inclined at a small angle forwardly and downwardly and having a downwardly facing surface 19. Body 11 defines a generally horizontally extending bottom wall 20 having an upwardly facing surface 21. Body 11 further defines a generally vertically extending rear wall 22 having a forwardly facing surface 23. Surfaces 19, 21, and 23 cooperatively define the lamp space 15.

The invention comprehends the provision of a layer of light-diffusing reflective material on each of the surfaces 19, 21 and 23, and in the illustrated embodiment, each of the layers of light-diffusing reflective material comprises a sheet of material adhered to the corresponding surface.

More specifically, the invention comprehends the provision of a sheet 24 of synthetic resin, such as vinyl resin, affixed by adhesive to the surface 19 of wall 18, a sheet 25 of similar material affixed by adhesive to the bottom wall surface 21, and a sheet 26 of similar material affixed by adhesive to the rear wall surface 23.

The synthetic resin preferably comprises a sheet of glossy white vinyl resin. The sheets are affixed to the corresponding wall surfaces by an adhesive capable of withstanding a temperature of 175° F. for at least 10 hours without loss of adhesion. Such adhesives are well-known in the art.

In the illustrated embodiment, sheet 24 and sheet 25 are identically configured sheets and are mounted to the wall surfaces 19 and 23 in reverse disposition. Thus, as seen in FIGS. 4 and 6, sheets 24 and 25 have similar first transverse edges 27, transverse edge 27 of sheet 25 being forwardly disposed and transverse edge 27 of sheet 24 being rearwardly disposed. The sheets 24 and 25 further define second transverse edges 28, transverse edge 28 of sheet 25 being rearwardly disposed and transverse edge 28 of sheet 24 being forwardly disposed on the surfaces 21 and 19, respectively.

Edge 27, as shown in FIGS. 4 and 6, defines a rectilinear edge having a central recess 29. Edge 28, as shown in FIGS. 4 and 6, defines a trapezoidal projecting edge having a transverse midportion 30, an angled side portions 31 and 32 at opposite sides of the midportion 30.

Sheets 24 and 25 further include a pair of transversely spaced slits 39 extending a major portion of the width of the sheet from edge portion 30 toward edge 27.

Sheet 26 defines an upper rectilinear edge 33 and a lower edge 34 provided with a downwardly opening arcuate recess 35 corresponding to a similar recess 36 providing clearance with the lamp 13 and socket 14.

As shown in FIG. 1, rear wall 22 defines a pair of side portions 37 which are inclined forwardly outwardly from the central recess 36.

A suitable light-transmitting lens 38 is mounted to the housing 12 to extend across window 16 and transmit light from the lamp space 15 forwardly and downwardly onto the subjacent floor surface F in a preselected pattern, as illustrated in FIG. 2. As indicated briefly above, the window 16 is disposed rearwardly of the forwardmost portion 17 of the nozzle and light directed outwardly through window 16 and lens 38 directly from lamp 13 is directed at a first range of small angles to the horizontal, as shown in FIG. 3. A portion of the light emitted from lamp 13 is reflected from the top wall sheet 24 through the window at an angle to the horizontal greater than the maximum angle of the range of angles of light emitted directly from lamp 13 through the window, thereby illuminating the floor surface more closely adjacent the front portion 17 of the nozzle body, as illustrated in FIGS. 2 and 3.

Thus, the present invention provides means for directing light over a substantial area directly in front of the nozzle, including an area closely adjacent the front portion 17 thereof, which cannot be normally illuminated by the direct light rays from the lamp as a result of the low profile of the nozzle. The us of the diffusing light reflecting sheets on the top, bottom and rear wall surfaces defining the lamp space provides an improved transmission of light from the top wall surface above the lamp so as to provide an elevated light-emitting means while yet permitting the lamp to be disposed at a lower elevation in the nozzle structure.

It has been found that the use of the glossy white vinyl sheet material provides an improved uniform lighting of the floor area immediately adjacent the front portion 17 of the nozzle.

Inasmuch as the sheets 24 and 25 are identical, minimization of the cost of the provision of the light-reflecting means is effected.

The invention permits the use of a relatively low wattage lamp, such as a 15-watt lamp, while yet providing improved lighting of the floor surface immediately adjacent the front of the nozzle in the vacuum cleaning use thereof. In comparison tests with the light-illuminating means of the prior art utilized in a number of commercially available vacuum cleaners, the light distribution of the lighting system embodying the invention proved superior to all of the competitive devices, including those utilizing 20-watt and 25-watt lamps. Thus, the invention provides not only improved lighting of the floor surface being cleaned, but also reduces the energy cost of the use of the vacuum cleaner.

The foregoing disclosure of specific embodiments is illustrative of the broad inventive concepts comprehended by the invention.

I claim:

1. In a vacuum cleaner nozzle structure having a housing defining a front wall provided with a window for passing light from within said housing to forwardly and downwardly of said front wall, a generally horizontally extending top wall, a generally horizontally extending bottom wall having an upwardly facing surface, and a generally vertically extending rear wall having a forwardly facing surface, said walls cooperatively defining a generally parallelepiped lamp space having a midportion, and a lamp in said space disposed more closely to said bottom wall than to said top wall providing a first generally horizontal light emanation from said space, the improvement comprising means on said top wall defining a reflective surface facing at a small angle rearwardly and downwardly for reflecting light from said lamp forwardly and downwardly to provide a second light emanation from said lamp space directed angularly downwardly to the horizontal to below said first light emanation immediately forwardly of said front wall wherein said layer of light-diffusing, reflective material comprises a sheet of synthetic resin.

2. In a vacuum cleaner nozzle structure having a housing defining a front wall provided with a window for passing light from within said housing to forwardly and downwardly of said front wall, a generally horizontally extending top wall, a generally horizontally extending bottom wall having an upwardly facing surface, and a generally vertically extending rear wall having a forwardly facing surface, said walls cooperatively defining a generally parallelepiped lamp space having a midportion, and a lamp in said space disposed more closely to said bottom wall than to said top wall providing a first generally horizontal light emanation from said space, the improvement comprising means on said top wall defining a reflective surface facing at a small angle rearwardly and downwardly for reflecting light from said lamp forwardly and downwardly to provide a second light emanation from said lamp space directed angularly downwardly to the horizontal to below said first light emanation immediately forwardly of said front wall wherein said layer of light-diffusing, reflective material comprises a sheet of vinyl resin.

3. In a vacuum cleaner nozzle structure having a housing defining a front wall provided with a window for passing light from within said housing to forwardly and downwardly of said front wall, a generally horizontally extending top wall, a generally horizontally extending bottom wall having an upwardly facing surface, and a generally vertically extending rear wall having a forwardly facing surface, said walls cooperatively defining a generally parallelepiped lamp space having a midportion, and a lamp in said space disposed more closely to said bottom wall than to said top wall providing a first generally horizontal light emanation from said space, the improvement comprising means on said top wall defining a reflective surface facing at a small angle rearwardly and downwardly for reflecting light from said lamp forwardly and downwardly to provide a second light emanation from said lamp space directed angularly downwardly to the horizontal to below said first light emanation immediately forwardly of said front wall wherein said layer of light-diffusing, reflective material comprises a sheet of glossy white synthetic resin.

4. In a vacuum cleaner nozzle structure having a housing defining a front wall provided with a window for passing light from within said housing to forwardly and downwardly of said front wall, a generally horizontally extending top wall, a generally horizontally extending bottom wall having an upwardly facing surface, and a generally vertically extending rear wall having a forwardly facing surface, said walls cooperatively defining a generally parallelepiped lamp space having a midportion, and a lamp in said space disposed more closely to said bottom wall than to said top wall providing a first generally horizontal light emanation from said space, the improvement comprising means on said top wall defining a reflective surface facing at a small angle rearwardly and downwardly for reflecting light from said lamp forwardly and downwardly to provide a second light emanation from said lamp space directed angularly downwardly to the horizontal to below said first light emanation immediately forwardly of said front wall wherein said layer of light-diffusing, reflective material comprises a sheet of flexible material adhered to the top wall surface.

5. In a vacuum cleaner nozzle structure having a housing defining a front wall provided with a window for passing light from within said housing to forwardly and downwardly of said front wall, a generally horizontally extending top wall, a generally horizontally extending bottom wall having an upwardly facing surface, and a generally vertically extending rear wall having a forwardly facing surface, said walls cooperatively defining a generally parallelepiped lamp space having a midportion, and a lamp in said space disposed more closely to said bottom wall than to said top wall providing a first generally horizontal light emanation from said space, the improvement comprising means on said top wall defining a reflective surface facing at a small angle rearwardly and downwardly for reflecting light from said lamp forwardly and downwardly to provide a second light emanation from said lamp space directed angularly downwardly to the horizontal to below said first light emanation immediately forwardly of said front wall wherein said layer of light-diffusing, reflective material comprises a sheet of flexible material adhered to the top wall surface with an adhesive capable of withstanding a temperature of 175° F. for at least 10 hours without loss of adhesion.

6. In a vacuum cleaner nozzle structure having a housing defining a front wall provided with a window for passing light from within said housing to forwardly and downwardly of said front wall, a generally horizontally extending top wall, a generally horizontally extending bottom wall having an upwardly facing surface, and a generally vertically extending rear wall having a forwardly facing surface, said walls cooperatively defining a generally parallelepiped lamp space having a midportion, and a lamp in said space disposed more closely to said bottom wall than to said top wall providing a first generally horizontal light emanation from said space, the improvement comprising means on said top wall defining a reflective surface facing at a small angle rearwardly and downwardly for reflecting light from said lamp forwardly and downwardly to provide a second light emanation from said lamp space directed angularly downwardly to the horizontal to below said first light emanation immediately forwardly of said front wall wherein a layer of light-diffusing, reflective material is provided in said bottom wall upwardly facing surface and said layer of light-diffusing, reflective material on said top wall surface and bottom wall surface comprises identically configured sheets of synthetic resin adhered to said top and bottom wall surfaces.

7. In a vacuum cleaner nozzle structure having a housing defining a front wall provided with a window for passing light from within said housing to forwardly and downwardly of said front wall, a generally horizontally extending top wall, a generally horizontally extending bottom wall having an upwardly facing surface, and a generally vertically extending rear wall having a forwardly facing surface, said walls cooperatively defining a generally parallelepiped lamp space having a midportion, and a lamp in said space disposed more closely to said bottom wall than to said top wall providing a first generally horizontal light emanation from said space, the improvement comprising means on said top wall defining a reflective surface facing at a small angle rearwardly and downwardly for reflecting light from said lamp forwardly and downwardly to provide a second light emanation from said lamp space directed angularly downwardly to the horizontal to below said first light emanation immediately forwardly of said front wall wherein a layer of light-diffusing, reflective material is provided in said bottom wall upwardly facing surface and said layer of light-diffusing, reflective material on said top wall surface and bottom wall surface comprises identically configured sheets of synthetic resin adhered to said top and bottom wall surfaces, said sheets having opposite first and second transverse edges, the first transverse edge of the sheet adhered to said bottom wall surface being forwardly disposed and the first transverse edge of the sheet adhered to said top wall surface being rearwardly disposed.

8. In a vacuum cleaner nozzle structure having a housing defining a front wall provided with a window for passing light from within said housing to forwardly and downwardly of said front wall, a generally horizontally extending top wall, a generally horizontally extending bottom wall having an upwardly facing surface, and a generally vertically extending rear wall having a forwardly facing surface, said walls cooperatively defining a generally parallelepiped lamp space having a midportion, and a lamp in said space disposed more closely to said bottom wall than to said top wall providing a first generally horizontal light emanation from said space, the improvement comprising means on said top wall defining a reflective surface facing at a small angle rearwardly and downwardly for reflecting light from said lamp forwardly and downwardly to provide a second light emanation from said lamp space directed angularly downwardly to the horizontal to below said first light emanation immediately forwardly of said front wall wherein a layer of light-diffusing, reflective material is provided in said bottom wall upwardly facing surface and said layer of light-diffusing, reflective material on said top wall surface and bottom wall surface comprises identically configured sheets of synthetic resin adhered to said top and bottom wall surfaces, said sheets having opposite first and second transverse edges, the first transverse edge of the sheet adhered to said bottom wall surface being forwardly disposed and the first transverse edge of the sheet adhered to said top wall surface being rearwardly disposed and defining a rectilinear edge having a central recess.

9. In a vacuum cleaner nozzle structure having a housing defining a front wall provided with a window for passing light from within said housing to forwardly and downwardly of said front wall, a generally horizontally extending top wall, a generally horizontally extending bottom wall having an upwardly facing surface, and a generally vertically extending rear wall having a forwardly facing surface, said walls cooperatively defining a generally parallelepiped lamp space having a midportion, and a lamp in said space disposed more closely to said bottom wall than to said top wall providing a first generally horizontal light emanation from said space, the improvement comprising means on said top wall defining a reflective surface facing at a small angle rearwardly and downwardly for reflecting light from said lamp forwardly and downwardly to provide a second light emanation from said lamp space directed angularly downwardly to the horizontal to below said first light emanation immediately forwardly of said front wall wherein a layer of light-diffusing, reflective material is provided in said bottom wall upwardly facing surface and said layer of light-diffusing, reflective material on said top wall surface and bottom wall surface comprises identically configured sheets of synthetic resin adhered to said top and bottom wall surfaces, said sheets having opposite first and second transverse edges, the first transverse edge of the sheet adhered to said bottom wall surface being forwardly disposed and the first transverse edge of the sheet adhered to said top wall surface being rearwardly disposed, and said second transverse edge defines a trapezoidal projecting edge having a transverse midportion and angled side portions at opposite sides of said midportion.

* * * * *